United States Patent [19]

Vath

[11] Patent Number: 4,524,903

[45] Date of Patent: Jun. 25, 1985

[54] ONE-PIECE TWO-WAY MAILER UNIT

[75] Inventor: F. Leo Vath, Brookville, Ohio

[73] Assignee: The Standard Register Company, Dayton, Ohio

[21] Appl. No.: 590,840

[22] Filed: Mar. 19, 1984

[51] Int. Cl.[3] ..... B65D 27/06

[52] U.S. Cl. ..... 229/73; 229/92.3

[58] Field of Search ..... 229/73, 69, 92.3

[56] References Cited

U.S. PATENT DOCUMENTS

| | | | |
|---|---|---|---|
| 730,933 | 6/1903 | Lawson . | |
| 769,536 | 9/1904 | Dixon . | |
| 1,371,670 | 3/1921 | Dority et al. . | |
| 1,438,122 | 12/1922 | McCoy . | |
| 1,995,183 | 3/1935 | Kovnat . | |
| 2,116,230 | 5/1938 | Berkowitz . | |
| 2,355,348 | 8/1944 | Welliver et al. . | |
| 2,669,464 | 2/1954 | Lay et al. . | |
| 2,773,638 | 12/1956 | Krohn . | |
| 2,877,944 | 3/1959 | Hyman . | |
| 2,895,664 | 7/1959 | Cone . | |
| 2,910,222 | 10/1959 | Bermingham, Jr. et al. . | |
| 2,983,431 | 5/1961 | Turan . | |
| 3,062,431 | 11/1962 | Rabenold . | |
| 3,312,385 | 4/1967 | Amort | 229/73 |
| 3,411,699 | 11/1968 | Pine et al. | 229/69 |
| 3,802,618 | 4/1974 | Wiessner . | |
| 3,981,435 | 9/1976 | Johnsen | 229/73 |
| 4,012,268 | 3/1977 | Johnsen | 229/69 |
| 4,055,294 | 10/1977 | Traise . | |
| 4,190,162 | 2/1980 | Buescher . | |
| 4,239,114 | 12/1980 | Denay | 229/69 |
| 4,332,346 | 6/1982 | Kronman . | |
| 4,334,618 | 6/1982 | Buescher | 229/73 |
| 4,403,696 | 9/1983 | Newell | 229/73 |

*Primary Examiner*—Stephen P. Garbe

*Attorney, Agent, or Firm*—Jacox & Meckstroth

[57] ABSTRACT

A two-way mailer unit which is formed from a single sheet of paperlike material. The sheet has first name and address and second name and address applied thereto. The sheet has a first severance line and a second severance line, separated by a first fold line. The sheet is folded, and portions thereof are attached together to form an envelope pocket section with a flap portion extending therefrom. A message section is provided between the severance lines. The folded sheet in such form is mailable to a recipient whose name and address appears as the first name and address. The sheet is severable by the recipient along the severance lines so that the envelope pocket section with the flap portion is separated from the message section. The recipient may then note the message section. The recipient places a message and/or payment piece within the envelope section. The flap portion of the envelope section is foldable over the envelope section to close the envelope section for remailing the remaining portion of the mailer unit to the second name and address.

8 Claims, 9 Drawing Figures

ONE-PIECE TWO-WAY MAILER UNIT

BACKGROUND OF THE INVENTION

In many types of business activities it is desirable to employ the use of a mailer unit which can be mailed by a sender to a recipient and which can be used by the recipient for transmission of material to the sender or to another person.

Many types of envelope structures have been created as a two-way mailer unit. However, many of such mailer units have been relatively difficult or expensive to produce. Some two-way mailer units have been structures which cannot reasonably be produced by automatically operating machines. Some mailer units cannot be produced effectively in series formation for separation into individual mailer units.

Some two-way mailer units have been difficult for the recipient to open and/or to place in condition for remailing.

Another problem exists in that most known two-way mailer units have required more than one sheet in construction and therefore require collating of a plurality of sheets.

Another problem in regard to two-way mailer devices is that many such mailer devices have not been attractive in appearance.

It is therefore an object of this invention to provide a two-way mailer unit which is produced by use of a single piece of paperlike material. Therefore, collating of a plurality of sheets is not necessary.

It is another object of this invention to provide such a one-piece two-way mailer unit which can be produced, including the printing thereof, as a series of units in a web formation and then separated into individual units, and in which all production operations can be in-line operations performed by automatically operating machines.

It is another object of this invention to provide such a one-piece two-way mailer unit which can be easily and readily opened by a recipient and which can be easily and readily placed in condition for remailing.

Another object of this invention is to provide such a one-piece two-way mailer unit which is attractive in appearance and which can be produced at relatively low costs.

Other objects and advantages of this invention reside in the construction of parts, the combination thereof, the method of production, and the mode of use, as will become more apparent from the following description.

SUMMARY OF THE INVENTION

This invention comprises a single sheet of paperlike material which is printed on opposite surfaces thereof, to provide an information or message region and to provide a first name and address region and a second name and address region. Postage information may also be printed upon the sheet. The sheet is folded into two substantially equal superposed portions. The superposed portions are glued together to form an envelope pocket section with a flap part and an information part extending therefrom, with the flap part and information part attached together by the fold in the sheet. The envelope pocket section contains the first name and address. The sheet has two separation lines so each of the superposed portions is separated into two parts when the folded sheet is grasped and snapped apart. When the portions are snapped apart, the information part is removed from the other portions of the unit, and a flap part is formed as an extension from the envelope pocket section. The envelope pocket section is thus in condition to receive an enclosure which may consist of the information part and/or another piece of material, such as a check or the like. After the pieces of material are placed within the envelope pocket section, the flap part is folded over the envelope pocket section and sealed thereto. The flap part, when folded over the envelope pocket section may serve as a mailing address portion for remailing the envelope pocket section.

DETAILED DESCRIPTION OF THE INVENTION

Figure 1:
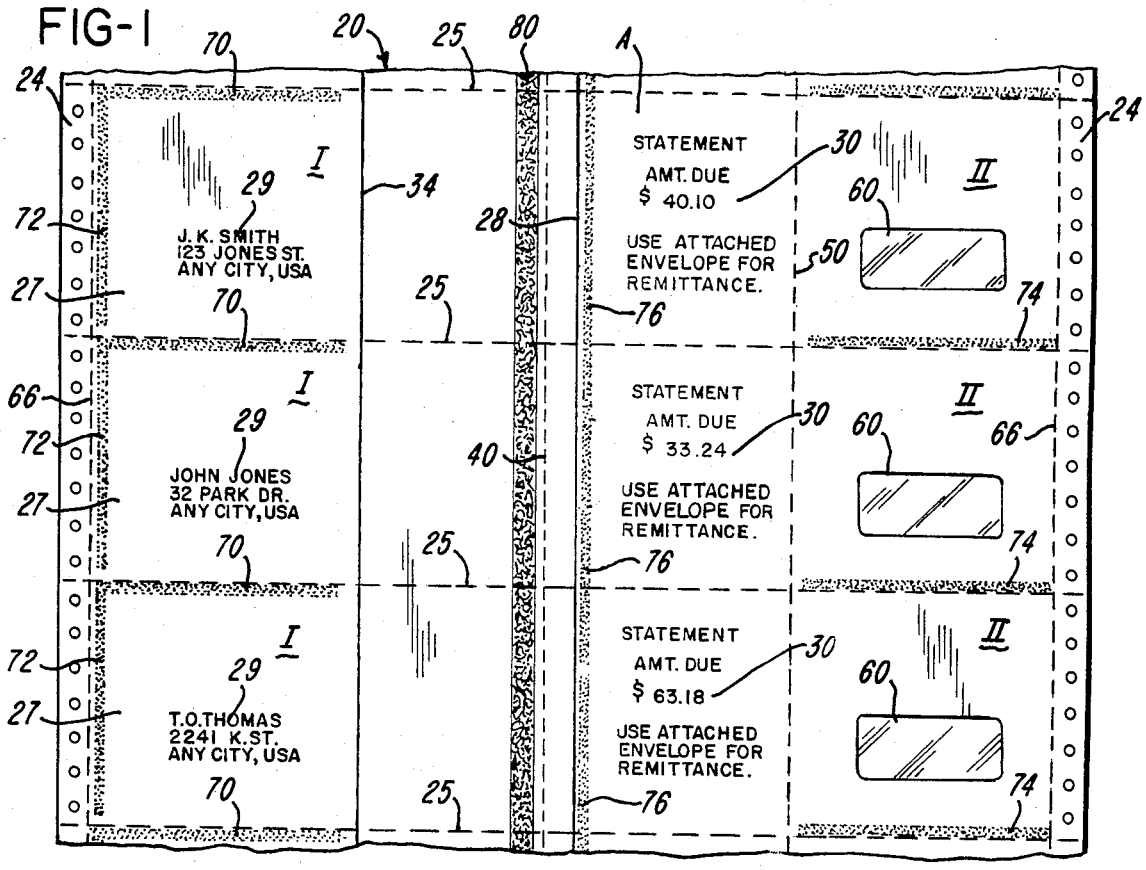
FIG. 1 is a plan view illustrating a first step in production of a series of one-piece two-way mailer units by the use of a single-ply web in accordance with this invention. This figure shows one surface of the web.
Figure 2:
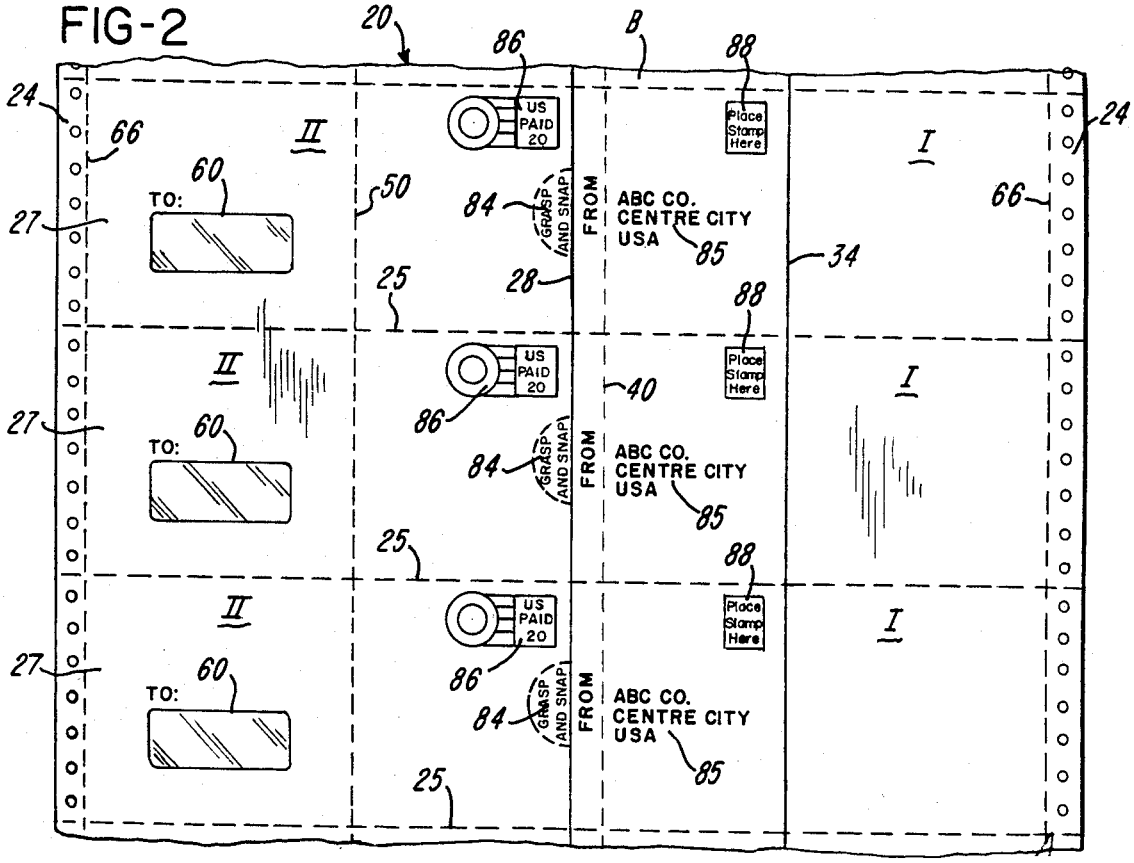
FIG. 2 is a plan view showing the opposite surface of the web.

Mailer units of this invention are preferably produced by the use of a single ply web of paperlike material. FIGS. 1 and 2 show a web 20 of paperlike material. The web 20 has a row 24 of marginal feed holes along each of the opposite side edges thereof for movement of the web 20. Spaced-apart score lines 25 extend across the web 20 and divide the web 20 into a series of units 27. Each unit 27 has a width dimension extending parallel to the rows 24 of feed holes and a length dimension transverse to the rows 24 of feed holes. The surface of the web 20 shown in FIG. 1 is referred to herein as surface A. The surface of the web 20 shown in FIG. 2 is referred to herein as surface B. A fold line 28 extends across the width dimension of each unit 27 at the middle of the length dimension and divides the unit 27 into two substantially equal parts, herein shown as part I and part II. An individual's name and address is printed upon an information region 29 of the surface A of the lefthand part of each unit 27. A financial statement for that individual is printed upon an information or message region 30 on the surface A of the righthand part of each unit 27, adjacent the fold line 28.

Adjacent the information region 29 and extending across the width dimension of the part I of each unit 27 is a fold line 34. Spaced from the fold line 34 in each part I of each unit 27 is a severance line 40. Adjacent the information or message region 30 in each part II is a severance line 50. Adjacent the severance line 50 is a window 60. Preferably, the window 60 is covered by transparent material which is attached to the surface A. Shown adjacent the row 24 of feed holes at the lefthand and righthand edges of the unit 27 is a severance line 66.

FIG. 1 shows that the surface A of each unit 27 has a strip 70 of glue along the upper edge of the part I and a strip 72 of glue along the lefthand edge of the part I. This figure also shows that the surface A has a strip 74 of glue along the lower edge of the part II and a strip 76 of glue along the part II extending along the width dimension thereof, adjacent the fold line 28. It is to be understood, however, that all of the glue represented by 70, 72, 74, and 76 may be applied to either the part I or the part II, or to both part I and part II as shown. The glue strips 70, 72, 74, and 76 are shown in FIG. 1 in a solid form but are heat meltable for adhesion. FIG. 1 also shows that the surface A of each unit 27 carries a strip 80 of adhesive adjacent the severance line 40, which may be of the remoist type or which may be covered with a removable protective strip.

FIG. 2 shows the surface B of the web 20, which is opposite the surface A shown in FIG. 1. Shown printed upon the surface B adjacent the window 60 of each unit 27 is the word "To". Shown printed between the fold line 28 and the severance line 40 is the word "From". Adjacent the fold line 28 is an arcuate region 84 which carries the words "Grasp and Snap". An information region 85 on the surface B of part II carries the name and address of the sender. An area 86 on the surface A of the part II is adapted to have postage printed thereupon or attached thereto. An area 88 is adapted to have postage applied thereto.

Figure 3:
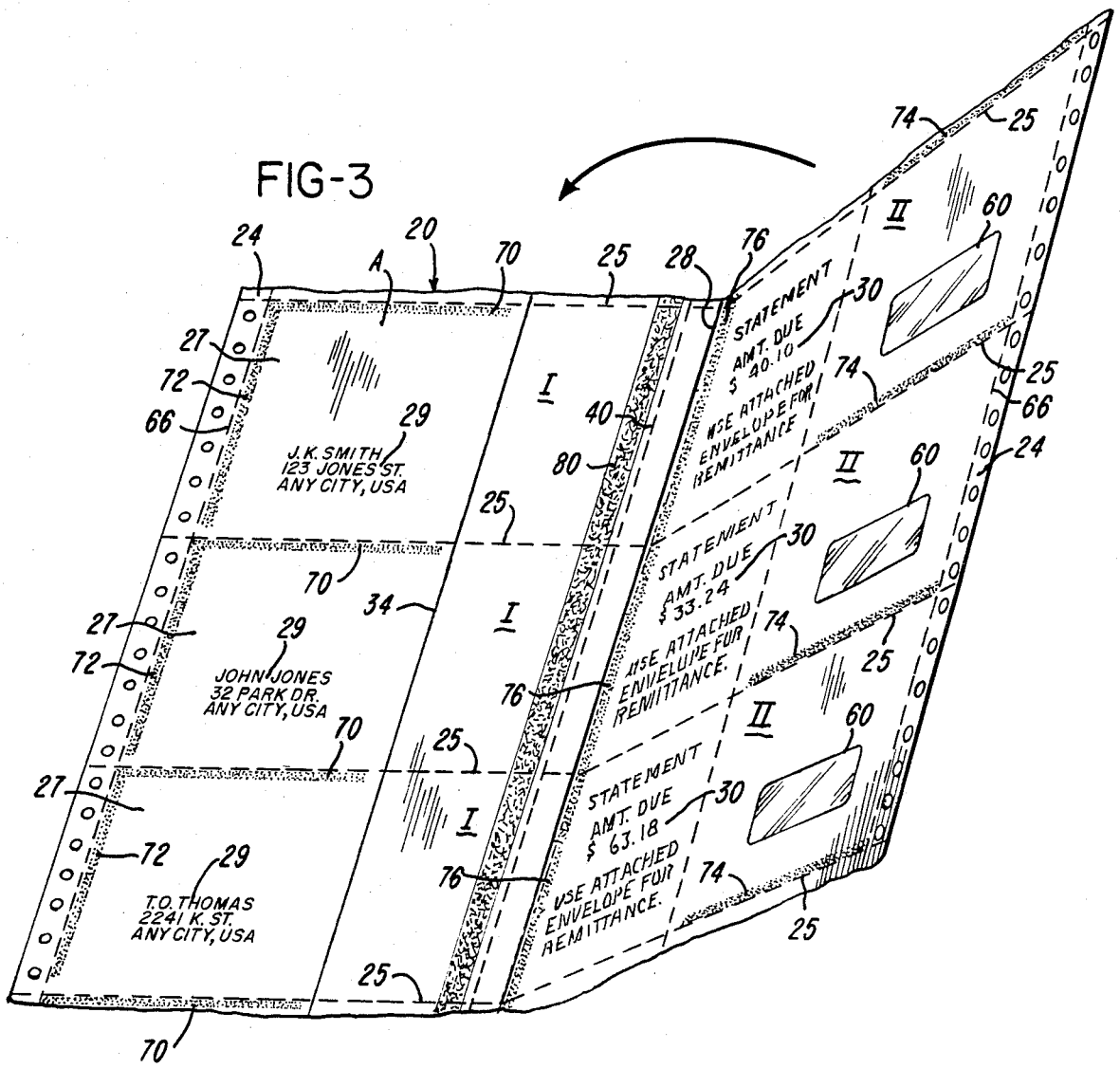
FIG. 3 is a perspective view illustrating the folding of the web as a subsequent step in the production of a series of one-piece two-way mailer units in accordance with this invention.

As stated, FIGS. 1 and 2 show a web 20 which carries a series of individual mailer units 27. As the web 20 travels, printing is applied thereto. Then glue 70, 72, 74, and 76 and adhesive 80 are applied to the web 20. Then the web 20 is folded along the fold line 28, as illustrated in FIG. 3. Thus, substantially equal portions of the surface A of the web 20 on each side of the fold line 28 come into engagement one with the other. The rows 24 of feed holes are superimposed one above the other. The printed material in the information region 29 appears through the window 60. The strips 70, 72, and 74 of glue form a generally U-shape configuration as they engage opposite areas of the surface A to outline a pocket. The strip of glue 76 engages the portion of the surface A between the severance line 40 and the fold line 28.

The web 20 in its folded condition is then heated so that the strips 70, 72, 74, and 76 of glue are melted. Pressure is applied upon the folded web 20 to force the melted glue into firm contact with the opposed portions of the surface A. Then while pressure is applied the folded web 20 is cooled or permitted to cool so that the strips 70, 72, 74, and 76 of glue are solidified and attach opposed portions of the surface A together. The strips 70, 72, and 74 of glue attach together portions of the unit 27 and form a pocket which is open along the fold line 34. The strip 76 of glue attaches the portion of the unit 27 between the severance line 40 and the fold line 28 of the part I to a facing corresponding portion of the part II. Thus, the portion of the unit 27 which carries the word "From" is attached to the portion which carries the message region 30. The portion of the unit 27 between the fold line 34 and the severance line 40 becomes a flap part which is in facing engagement with the information region 30.

Figure 4:
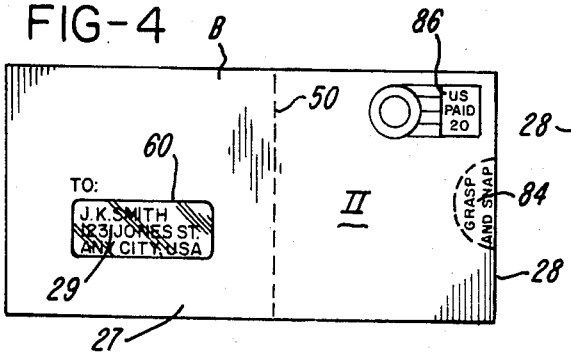
FIG. 4 is a plan view showing the front surface of an individual mailer unit produced in accordance with this invention.
Figure 5:
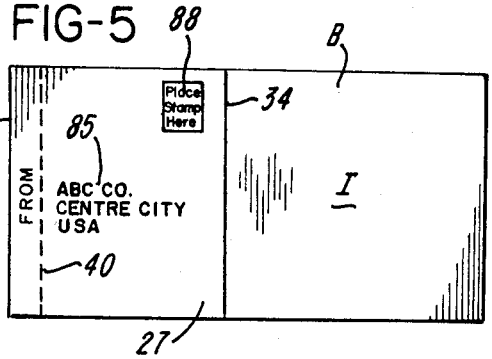
FIG. 5 is a plan view showing the back surface of the mailer unit of FIG. 4.

Then the marginal portion of the folded web 20, along the lefthand part of the folded web 20, is trimmed by cutting along the severance lines 66, which are one above the other, to remove the superposed rows 24 of feed holes. Then each individual mailer unit 27 is removed from the web 20. Thus, each individual mailer unit 27 appears substantially as shown in FIGS. 4 and 5 and is in condition to be mailed to a recipient. The name and address of the recipient appears through the window 60, as shown in FIG. 4. The proper postage appears in the area 86 at the upper righthand corner of the unit 27, as shown in FIG. 4.

As shown in FIG. 5, the area between the fold line 28 and the severance line 40 carries the word "From" and adjacent thereto is the information region 85 upon which the return name and address appears.

Figure 6:
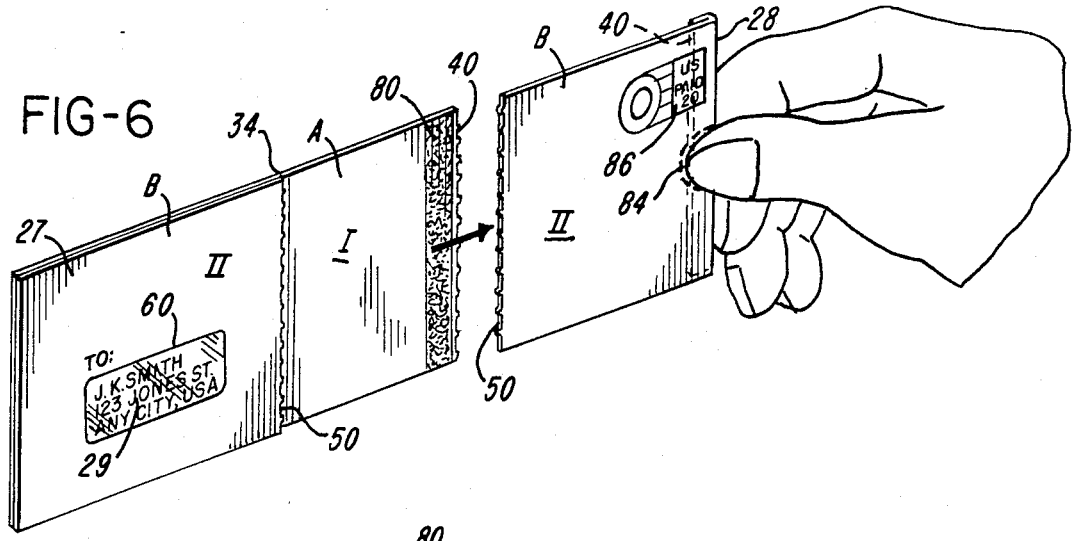
FIG. 6 is a perspective view illustrating the separation of the mailer unit into two parts.

When the recipient of the mailer unit 27 desires to open the mailer unit 27, the arcuate region 84 adjacent the righthand edge of the unit 27, as shown in FIG. 4, is grasped with one hand and the lefthand edge is grasped with the other hand, and then a snap-apart action is effected. Thus, there is severance along the severance lines 40 and 50, as illustrated in FIG. 6. Thus, the information region 30 is removed, along with the portion between the fold line 28 and the severance line 40, which carries the word "From".

Figure 7:
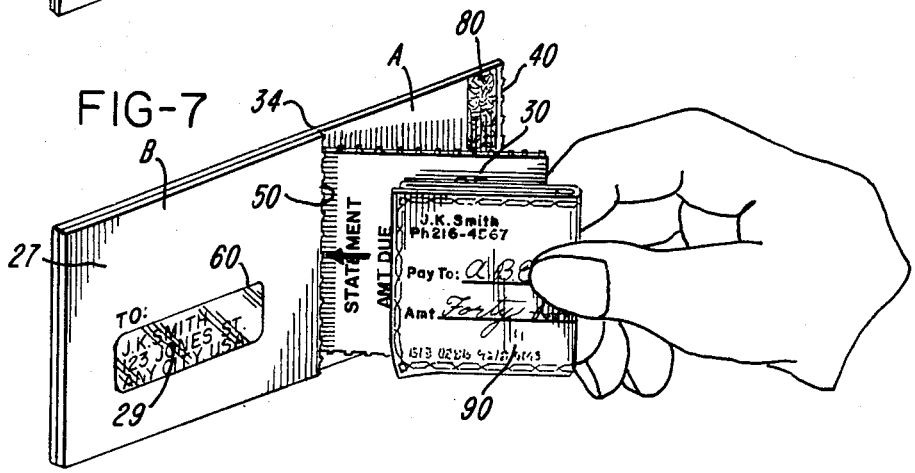
FIG. 7 is a perspective view illustrating the introduction of elements into the envelope pocket section of the mailer unit for remailing.
Figure 8:
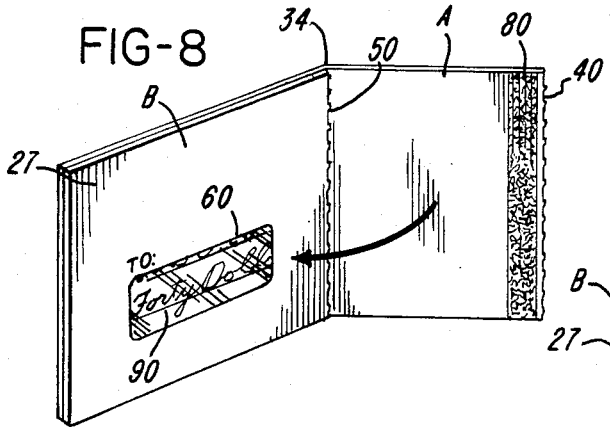
FIG. 8 is a perspective view illustrating the folding of the flap part upon the pocket section for remailing.
Figure 9:
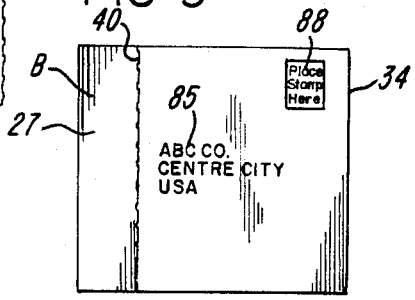
FIG. 9 is a plan view illustrating the mailer unit in condition for remailing.

The part of the unit 27 having the information region 30 can then be read by the recipient and is adapted to be inserted into the pocket bordered by the glue strips 70, 72, and 74, as illustrated in FIG. 7. The pocket is open along the fold line 34, as shown in FIG. 7. A check 90 is also shown being inserted into the pocket, as illustrated in FIG. 7. The portion of the unit 27 between the fold line 34 and the severance line 40 serves as a flap which is folded over the pocket portion to cover the window 60, as illustrated in FIG. 8. The adhesive strip 80 on the flap is moistened or uncovered to seal the flap to the surface B, as shown in FIG. 9.

Then, the recipient applies postage to the area 88. Then the mailer unit 27 is again in condition to be mailed. The information region 85 which served as the return name and address in original mailing of the unit 27 to the recipient, becomes the name and address to which the mailer unit 27 is mailed in the remailing process.

Thus, it is understood that a mailer unit 27 of this invention is produced from a single sheet of paperlike material which is folded after being printed upon and after having adhesive material applied thereto. Collating of a plurality of sheets to form an enclosure is not necessary. The mailer unit 27 contains a first address region and a second address region. The mailer unit 27 also contains an information or message region 30, which carries information, specifically directed to the recipient. As the recipient opens the mailer unit 27, a flap portion is automatically provided for folding over the pocket portion to form a return envelope. The flap portion carries the second address for mailing the unit 27.

Thus, an attractive two-way mailer is provided which is readily and easily opened by a recipient and which is easily and readily prepared for remailing by the recipient.

Although the preferred embodiment of the one-piece two-way mailer of this invention has been described, it will be understood that within the purview of this invention various changes may be made in the form, details, proportion and arrangement of parts, the combination thereof, and the mode of use, which generally stated consist in a construction within the scope of the appended claims.

The invention having thus been described, the following is claimed:

1. A one-piece two-way mailer unit comprising a single sheet of paper-like material having a predetermined width and length, the sheet having an inner surface and an outer surface and being folded at the middle of its length along a center fold line to define a first part and a second part, the inner surface of the first part opposing the inner surface of the second part and having a receiver's name and address information portion, the second part of the sheet having a window through which the receiver's name and address information portion is visible, the second part having a first severance line extending across its width and spaced parallel to the fold line to define therebetween a receiver's personalized information portion on the first surface, the first part having a second severance line extending across its width in close parallel spaced relation to the center fold line to define a connecting portion, the first part having a fold line across its width adjacent the receiver's name and address information portion, adhesive material attaching the inner surface of the first part to the inner surface of the second part in the connecting portion and also to form a pocket region at least partially encompassing the receiver's name and address information portion and the window with the pocket region being open along the fold line on the first part, the outer surface of the second part being adapted to carry postage information, the outer surface of the first part having a sender's name and address information portion between the connecting portion and the fold line on the first part, the single folded sheet thus being mailable to a receiver whose name and address appears through the window, the sheet being severable by the receiver along the first and second severance lines to separate and remove the receiver's personalized information portion of the second part and to create a return envelope with a flap portion extending from the pocket region, the flap portion being foldable along the fold line on the second part to cover at least a portion of the receiver's name and address to provide for mailing the return envelope to the sender's name and address.

2. The mailer unit of claim 1 in which the receiver's name and address is printed on the inner surface of the first part and in which the sender's name and address is printed on the outer surface of the first part between the severance line and fold line on the first part.

3. The mailer unit of claim 1 in which the sheet carries sender's name and ddress on the outer surface of the first part between the center fold line and the fold line on the first part, the sender's name and address thus appearing as the mailing name and address upon the return envelope when the flap portion is folded over.

4. The mailer device of claim 1 in which the second surface of the outer part between the center fold line and the first severance line carries postage information.

5. The mailer device of claim 1 in which the second surface of the outer part carries the word "To" adjacent the window.

6. The mailer device of claim 1 in which the outer surface of the first part carries postage information between the second severance line and the corresponding fold line.

7. A one-piece two-way mailer unit comprising a single sheet of paper-like material having a predetermined width and length, the sheet having an inner surface and an outer surface and being folded at the middle of its length along a center fold line to define a first part and a second part, the inner surface of the first part opposing the inner surface of the second part and having a receiver's name and address information portion, the second part of the sheet having a window through which the receiver's name and address information portion is visible, the second part having a first severance line extending across its width and spaced parallel to the fold line to define therebetween a receiver's personalized information portion on the first surface, the first part having a second severance line extending across its width in close parallel spaced relation to the center fold line to define a connecting portion, the first part having a fold line across its width adjacent the receiver's name and address information portion, adhesive material attaching the inner surface of the first part to the inner surface of the second part in the connecting portion and also to form a pocket region at least partially encompassing the receiver's name and address information portion and the window with the pocket region being open along the fold line on the first part, the outer surface of the second part being adapted to carry postage information, a strip of adhesive extending on the inner surface of the first part adjacent the connecting portion, the outer surface of the first part having a sender's name and address information portion between the connecting portion and the fold line on the first part, the single folded sheet thus being mailable to a receiver whose name and address appears through the window, the sheet being severable by the receiver along the first and second severance lines to separate and remove the receiver's personalized information portion of the second part and to create a return envelope with a flap portion extending from the pocket region, the flap portion being foldable along the fold line on the second part to cover at least a portion of the receiver's name and address and attachable by the strip of adhesive to the outer surface of the second part to provide for mailing the return envelope to the sender's name and address.

8. A one-piece two-way mailer unit adapted to be printed with information prior to folding and sealing, comprising a rectangular single sheet of paper having a predetermined width and length, the sheet having an inner surface and an outer surface and being folded at the middle of its length along a center fold line to define a first part and a second part, the inner surface of the first part opposing the inner surface of the second part and having a receiver's name and address printed thereon, the second part of the sheet having a window through which the receiver's name and address is visible, the second part having a first severance line extending across its width and spaced parallel to the fold line to define therebetween a receiver's personalized information portion on the first surface, the first part having a second severance line extending across its width in close parallel spaced relation to the center fold line to define a connecting portion, the first part having a fold line across its width adjacent the receiver's name and address, adhesive material attaching the inner surface of the first part to the inner surface of the second part in the connecting portion and also partially around the periphery of the first and second parts to form a pocket region at least partially encompassing the receiver's name and address and the window with the pocket region being open along the fold line on the first part, the outer surface of the second part having postage information, thereon, the outer surface of the first part having a sender's name and address thereon between the connecting portion and the fold line on the first part, the single folded sheet thus being mailable to a receiver whose name and address appears through the window, the sheet being severable by the receiver along the first and second severance lines to separate and remove the receiver's personalized information portion of the second part and to create a return envelope with a flap portion extending from the pocket region, the flap portion being foldable along the fold line on the second part to cover at least a portion of the receiver's name and address to provide for mailing the return envelope to the sender's name and address.

* * * * *

UNITED STATES PATENT AND TRADEMARK OFFICE

CERTIFICATE OF CORRECTION

PATENT NO. : 4,524,903

DATED : June 35, 1985

INVENTOR(S) : F. Leo Vath

It is certified that error appears in the above-identified patent and that said Letters Patent are hereby corrected as shown below:

Column 5, line 59, delete "second" and substitute therefor---outer---;

Column 5, line 60, change "outer" to---second---.

Column 5, line 62, cancel "second" and substitute therefor---outer---.

Column 5, line 63, cancel "outer" and substitute therefor---second---.

Signed and Sealed this

*Twelfth* Day of *November 1985*

[SEAL]

*Attest:*

DONALD J. QUIGG

*Attesting Officer*

*Commissioner of Patents and Trademarks*